US009753393B2

(12) United States Patent
Yaguchi

(10) Patent No.: US 9,753,393 B2
(45) Date of Patent: Sep. 5, 2017

(54) IMAGE FORMING APPARATUS POTENTIAL SURFACE DETECTOR

(71) Applicant: CANON KABUSHIKI KAISHA, Tokyo (JP)

(72) Inventor: Kazutaka Yaguchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/072,481

(22) Filed: Mar. 17, 2016

(65) Prior Publication Data

US 2016/0282746 A1 Sep. 29, 2016

(30) Foreign Application Priority Data

Mar. 23, 2015 (JP) ..... 2015-059774

(51) Int. Cl.
*G03G 15/00* (2006.01)
*G03G 15/02* (2006.01)
*G03G 15/043* (2006.01)

(52) U.S. Cl.
CPC ..... *G03G 15/0266* (2013.01); *G03G 15/043* (2013.01); *G03G 15/5037* (2013.01)

(58) Field of Classification Search
CPC ..... G03G 15/0266; G03G 15/0822; G03G 21/0094; G03G 15/043; G03G 15/1675; G03G 15/5037
USPC ..... 399/48, 49, 51
See application file for complete search history.

(56) References Cited

U.S. PATENT DOCUMENTS

| | | | | |
|---|---|---|---|---|
| 8,543,021 | B2 | 9/2013 | Sakata et al. | |
| 9,310,709 | B2 | 4/2016 | Yaguchi | |
| 2005/0271405 | A1* | 12/2005 | Kimura | G03G 15/065 399/50 |
| 2011/0217064 | A1* | 9/2011 | Sakata | G03G 15/02 399/89 |
| 2012/0155899 | A1* | 6/2012 | Watanabe | G03G 15/5058 399/49 |
| 2014/0178087 | A1* | 6/2014 | Suzuki | G03G 15/011 399/50 |

FOREIGN PATENT DOCUMENTS

JP 2012-013881 1/2012

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

The image bearing member includes an image bearing member, a charge unit that charges the image bearing member, an exposure unit that exposes the image bearing member by emitting light thereto, a transfer unit that transfers an image formed on the image bearing member, a detection unit that detects a current flowing between the transfer unit and the image bearing member when a voltage is applied to the transfer unit, and a control unit that causes the charge unit to charge the image bearing member through application of a DC voltage, and calculates a surface potential of the image bearing member based on a detection result of the current when the voltage is applied to the transfer unit, after a light whose light amount is higher than a light amount of a light emitted to the image bearing member from the exposure unit is emitted to the image bearing member.

10 Claims, 7 Drawing Sheets

IMAGE FORMING APPARATUS POTENTIAL SURFACE DETECTOR

BACKGROUND OF THE INVENTION

Field of the Invention

The present invention relates to an image forming apparatus, and more particularly, to an image forming apparatus having a function of detecting a potential of an image bearing member by detecting a current flowing to the image bearing member through a member.

Description of the Related Art

A contrast of an image formed by an image forming apparatus is determined based on a potential difference between a developing voltage and a surface potential of a photosensitive drum (hereinafter referred to as "photosensitive drum potential") exhibited after laser light is emitted thereto from a laser light source. However, the contrast of the image varies depending on an environment (for example, temperature and humidity) and a film thickness of the photosensitive drum, which necessitates a correction of the contrast. Therefore, in order to detect an actual photosensitive drum potential and enable a correction with high accuracy, an image forming apparatus configured to detect the photosensitive drum potential as follows is proposed in, for example, Japanese Patent Application Laid-Open No. 2012-13881. That is, an AC voltage is applied to the photosensitive drum from an application circuit for a charging voltage through a charge roller, and a residual potential on the photosensitive drum is eliminated. After that, DC voltages having a positive polarity and a negative polarity are applied to the photosensitive drum from the application circuit for the charging voltage through the charge roller, and discharge start voltages having a positive polarity and a negative polarity of the photosensitive drum are measured. The surface potential of the photosensitive drum is detected based on the measured discharge start voltages.

In a related-art configuration, the charging of the photosensitive drum and the detection of the photosensitive drum potential exhibited after the laser irradiation are conducted through the charge roller. Therefore, the photosensitive drum potential cannot be detected until a surface position in which the photosensitive drum has been charged by the charge roller returns to the position of the charge roller again after the photosensitive drum is rotated by one revolution, which requires time for the detection of the photosensitive drum potential. Further, for improvement in detection time, there is also a system that uses a transfer roller serving as a transfer member to detect the photosensitive drum potential exhibited after the laser irradiation, but a detection result of the photosensitive drum potential needs to be corrected. In order to calculate an amount (correction amount) by which the detection result of the photosensitive drum potential is to be corrected, an AC voltage needs to be applied by the charge roller. Therefore, a circuit configured to generate an AC voltage needs to be provided, which increases cost of a circuit configuration.

SUMMARY OF THE INVENTION

The present invention enables detection of a photosensitive drum potential to be conducted with an inexpensive circuit configuration.

In order to solve the above-mentioned problem, it is provided, an image forming apparatus including an image bearing member, a charge unit configured to charge the image bearing member, an exposure unit configured to expose the image bearing member by emitting light thereto, a transfer unit configured to transfer an image formed on the image bearing member, a detection unit configured to detect a current flowing between the transfer unit and the image bearing member when a voltage is applied to the transfer unit, and a control unit configured to cause the charge unit to charge the image bearing member through application of a DC voltage, and calculate a surface potential of the image bearing member based on a detection result of the current flowing to the image bearing member detected by the detection unit when the voltage is applied to the transfer unit after the exposure unit emits a light whose light amount value is higher than a light amount value of a light emitted to the image bearing member in an image formation, to the image bearing member.

Further features of the present invention will become apparent from the following description of exemplary embodiments with reference to the attached drawings.

DESCRIPTION OF THE EMBODIMENTS

Now, embodiments of the present invention are described in detail with reference to the accompanying drawings.

<First Embodiment>

[Outline of Image Forming Apparatus]

Figure 1:
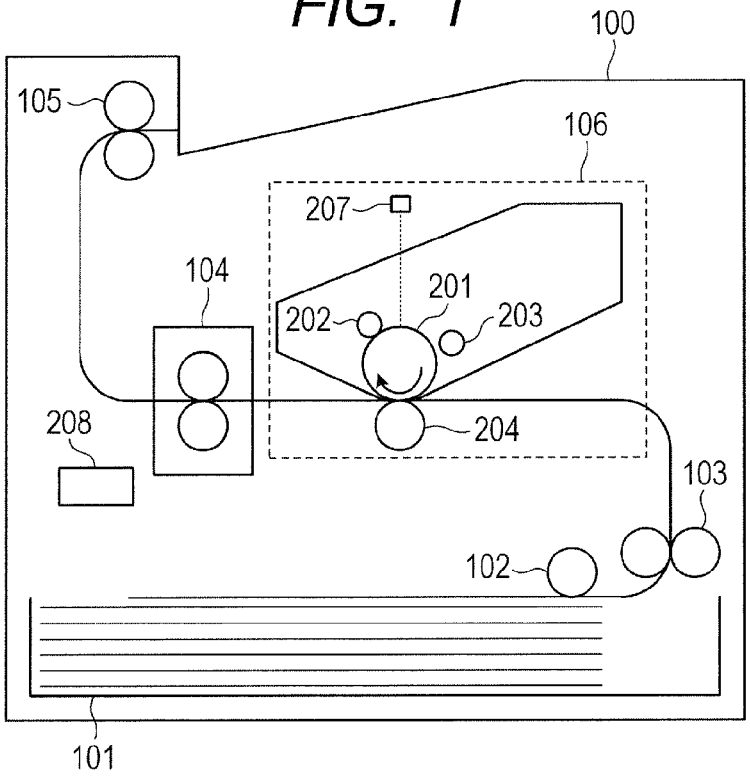
FIG. 1 is a schematic sectional view of an image forming apparatus according to a first embodiment and a second embodiment of the present invention.

FIG. 1 is a schematic sectional view of an electrophotographic laser beam printer 100 (hereinafter referred to as "printer 100") serving as an image forming apparatus to which a first embodiment of the present invention is applied. In FIG. 1, a sheet used as a recording material placed on a sheet feeding cassette 101 is picked up by a pickup roller 102, and conveyed to an image forming process unit 106 by a sheet feeding roller 103 driven by a drive unit (not shown). In the image forming process unit 106, an electrostatic latent image is formed on a photosensitive drum 201, which has been charged to a predetermined potential by a charge roller 202, through scanning using laser light emitted from a laser light source 207. The electrostatic latent image formed on the photosensitive drum 201 is developed with toner by a developing sleeve 203 to form a toner image on the photosensitive drum 201. Then, the toner image formed on the photosensitive drum 201 is transferred by a transfer roller 204 onto the sheet conveyed from the sheet feeding cassette 101, and the sheet is conveyed to a fixing device 104. In the fixing device 104, the unfixed toner image on the sheet is pressurized and heated to be fixed to the sheet. After that, the sheet delivered from the fixing device 104 is delivered to the outside of the printer 100 by the delivery roller 105. The above-mentioned image forming operation is controlled by a control unit 208 serving as control means for controlling an operation of the printer 100.

[Outline of Image Forming Process Unit]

Figure 2:
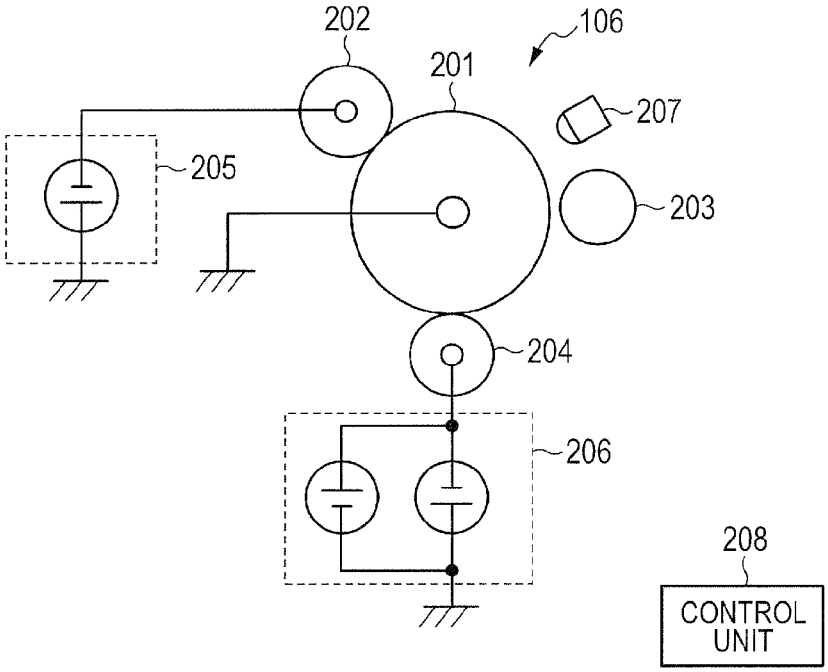
FIG. 2 is a schematic diagram for illustrating a configuration of an image forming process unit according to the first embodiment and the second embodiment.

FIG. 2 is a schematic diagram for illustrating a configuration of the image forming process unit 106. A charging voltage application circuit 205 serving as a voltage application unit of charging means applies a charging voltage to the charge roller 202, to thereby charge the photosensitive drum 201 serving as an image bearing member to the predetermined potential. Subsequently, the photosensitive drum 201 charged to the predetermined potential is scanned by the laser light emitted from the laser light source 207 based on an image signal, and the electrostatic latent image is formed on the photosensitive drum 201 (on the image bearing member). The formed electrostatic latent image is developed by a developer (toner) caused to adhere thereto by the developing sleeve 203, and the toner image is formed. A transfer voltage application circuit 206 serving as application means for a transfer voltage applies the transfer voltage to the transfer roller 204 serving as a transfer member, to thereby transfer the toner image on the photosensitive drum 201 onto the sheet nipped at a nip portion where the transfer roller 204 and the photosensitive drum 201 are brought into abutment with each other.

[Outline of Exposure Unit]

Figure 3A:
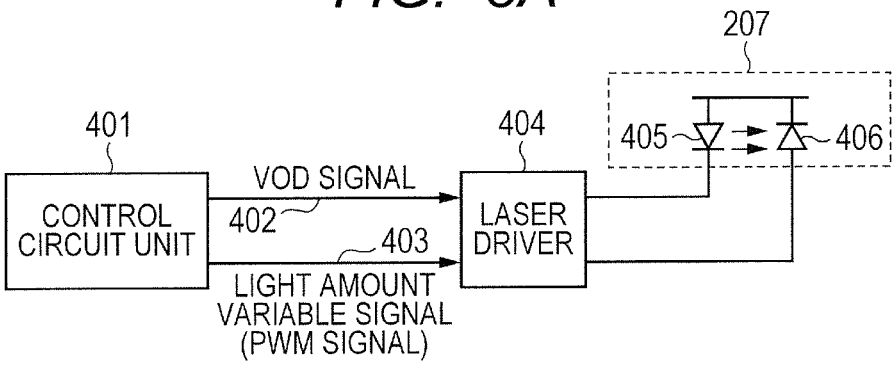
FIG. 3A is a schematic diagram for illustrating a configuration of an exposure unit according to the first embodiment and the second embodiment.

FIG. 3A is a schematic diagram for illustrating a configuration of an exposure unit serving as exposure means for emitting laser light to the photosensitive drum 201. The exposure unit includes a control circuit unit 401, a laser driver 404, and the laser light source 207. In addition, the laser light source 207 includes a laser diode 405 configured to emit laser light and a PD sensor 406 configured to detect a light amount of the laser light emitted by the laser diode 405. The laser driver 404 controls the light amount at a constant level while monitoring a light emission amount of the laser diode 405 by the PD sensor 406. The control circuit unit 401 outputs a VDO signal 402 to the laser driver 404. The VDO signal 402 is image data for forming an image, and is a signal for controlling light emission and turning-off of the laser diode 405. Further, the control circuit unit 401 outputs a light amount variable signal 403 serving as a pulse width modulation (PWM) signal modulated in pulse width to the laser driver 404. Further, the laser driver 404 is configured to vary the light amount of the laser diode 405 based on the light amount variable signal 403.

Further, the control circuit unit 401 controls the light amount variable signal 403 based on a light amount instruction issued from the control unit 208, which allows the control unit 208 to vary the light amount to be emitted to the photosensitive drum 201. The control unit 208 uses the transfer voltage application circuit 206 described later to detect a surface potential of the photosensitive drum 201 exhibited after a predetermined light amount is emitted from the laser light source 207. When the detected surface potential of the photosensitive drum 201 has a value different from a predetermined value, the control unit 208 causes the control circuit unit 401 to vary the light amount of the laser light to be emitted from the laser diode 405 of the laser light source 207. With this configuration, the surface potential of the photosensitive drum 201 can be changed.

[Outline of Transfer Voltage Application Circuit]

Figure 3B:
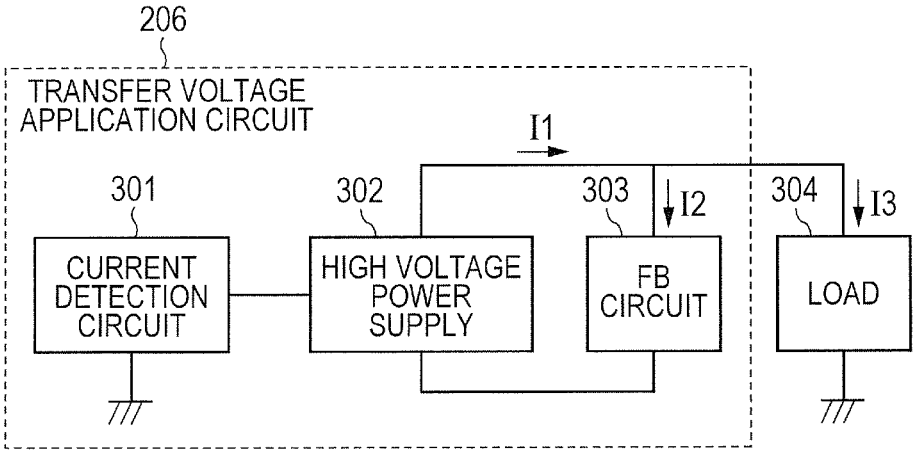
FIG. 3B is a schematic diagram for illustrating a configuration of a transfer voltage application circuit.

FIG. 3B is a schematic diagram for illustrating an outline of a configuration of the transfer voltage application circuit 206 according to this embodiment. The transfer voltage application circuit 206 includes a current detection circuit 301, a high voltage power supply 302 configured to generate the transfer voltage of a positive voltage and the transfer voltage of a negative voltage, and a feedback (FB) circuit 303 configured to control the high voltage power supply 302 so that a predetermined transfer voltage is output. The transfer voltage application circuit 206 outputs the transfer voltage to a load 304. Note that, the load 304 represents the transfer roller 204 and the photosensitive drum 201 to which an output current I3 flows from the transfer voltage application circuit 206.

The current detection circuit 301 serving as detecting means is a circuit configured to detect a current I1 obtained by adding a current I2 flowing to the FB circuit 303 and the current I3 flowing to the load 304 (=I2+I3). The high voltage power supply 302 is a constant voltage power supply capable of varying an output voltage to a positive polarity or a negative polarity, and applies the transfer voltage being a DC voltage to the transfer roller 204. The current detection circuit 301 detects the current I3 flowing to the photosensitive drum 201 through the transfer roller 204 when a high voltage is being output from the high voltage power supply 302. The control unit 208 applies different DC voltages to the transfer roller 204 from the high voltage power supply 302 at a non-image-formation time when image formation is not conducted for the sheet, for example, at a time of calibration before printing. Then, the current detection circuit 301 notifies the control unit 208 of current values detected when the respective DC voltages are applied. Based on a detection result obtained through the detection conducted by the current detection circuit 301, the control unit 208 determines a discharge start voltage between the photosensitive drum 201 and the transfer roller 204 described later, and calculates the surface potential of the photosensitive drum 201.

[Calculation of Discharge Start Voltage]

Figure 4A:
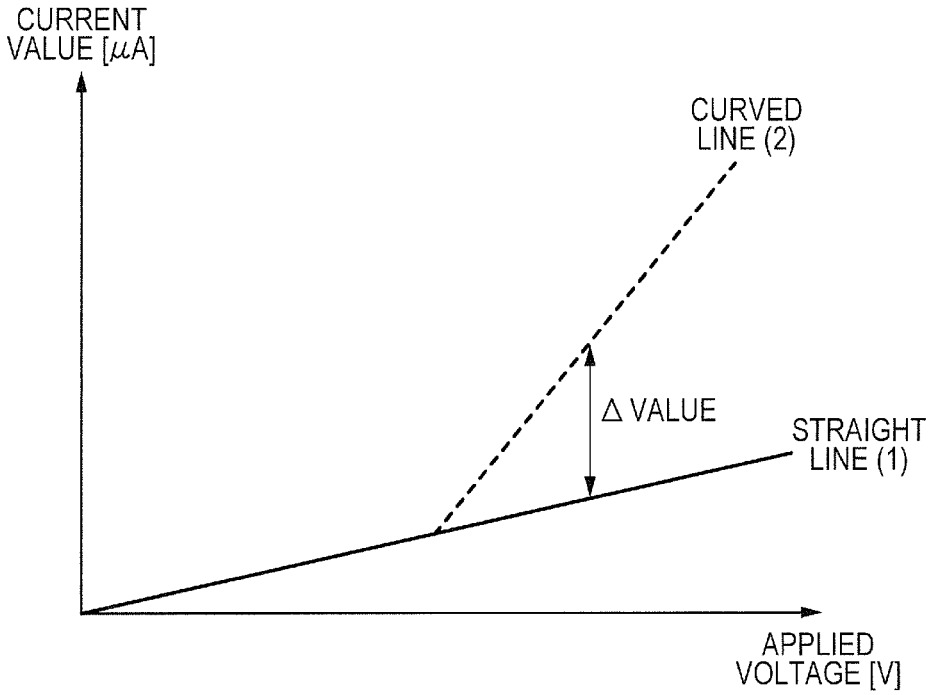
FIG. 4A and FIG. 4B are graphs showing a voltage-current characteristic of the photosensitive drum according to the first embodiment and the second embodiment.

Next, control for correcting an error of the calculated surface potential based on a calculation result for the surface potential of the photosensitive drum 201 is described. First, a method of calculating a discharge start voltage is described. FIG. 4A is a graph for showing a relationship between an applied voltage applied from the transfer voltage application circuit 206 to the transfer roller 204 and a current value of a current flowing to the transfer roller 204. In FIG. 4A, the horizontal axis indicates the applied voltage (unit: volt (V)), and the vertical axis indicates the current value (unit: microampere (μA)). As shown in FIG. 4A, the current corresponding to the voltage applied to the transfer roller 204 (current indicated by a straight line (1) in FIG. 4A) flows from the transfer roller 204 to the photosensitive drum 201 until the discharge is started (until the branch point between the straight line (1) and a curved line (2)). However, when the discharge between the photosensitive drum 201 and the transfer roller 204 is started, as indicated by the curved line (2) in FIG. 4A, the current starts to flow drastically from the transfer roller 204 to the photosensitive drum 201, and the curved line (2) becomes a curved line having an inflection point. Therefore, a current value of the discharge current flowing between the photosensitive drum 201 and the transfer roller 204 can be expressed by a Δ value representing a difference between the current value indicated by the curved line (2) and the current value indicated by the straight line (1). The applied voltage exhibited when the Δ value becomes a predetermined current value, for example, the applied voltage exhibited when the Δ value becomes 3 [μA] in a case where the applied voltage is a positive voltage or the applied voltage exhibited when the Δ value becomes −3 [μA] in a case where the applied voltage is a negative voltage, is determined as a voltage that causes the discharge to be started (hereinafter referred to as "discharge start voltage").

[Calculation of Surface Potential of Photosensitive Drum]

Figure 4B:
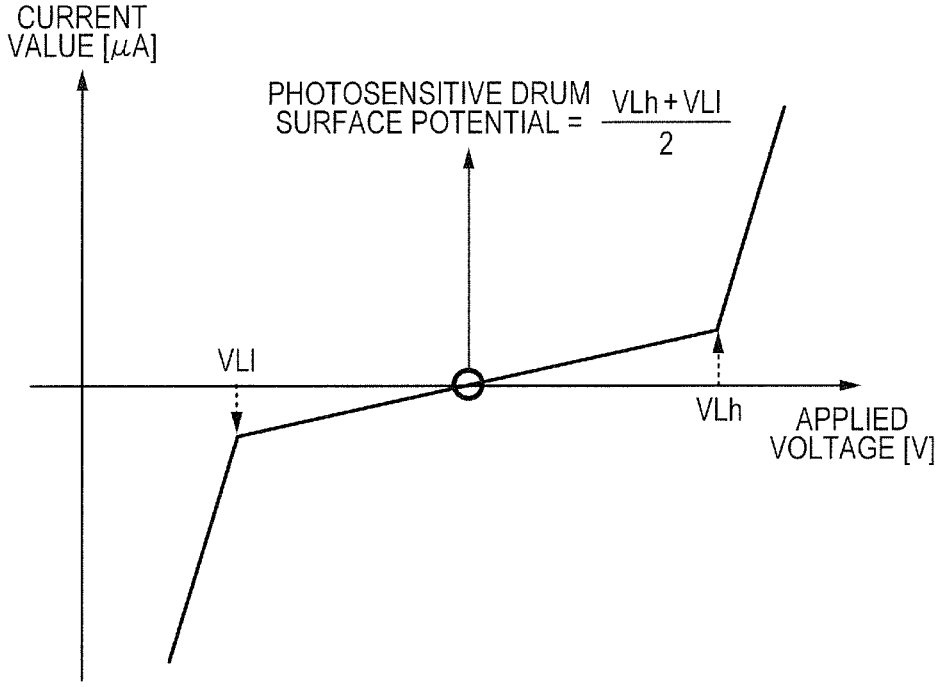

As a discharge characteristic of the photosensitive drum 201, a potential difference required for the discharge differs depending on an environment (for example, temperature and humidity) and a difference in the film thickness of the photosensitive drum 201. FIG. 4B is a voltage-current characteristic graph for showing a relationship between the applied voltage for the photosensitive drum 201 and the current value of the discharge current flowing to the photosensitive drum 201. In FIG. 4B, the horizontal axis indicates the applied voltage [V], and the vertical axis indicates the current value [μA]. When the surface of the transfer roller 204 has no irregularities as exhibited by the surface of the photosensitive drum 201, as shown in FIG. 4B, the potential difference required to cause the discharge to be started with respect to the surface potential of the photosensitive drum 201 has a symmetric relationship between a positive potential and a negative potential (positive/negative symmetry). That is, the transfer voltage having a positive potential (positive polarity) starts being applied to the photosensitive drum 201 from the current value of 0 μA in FIG. 4B (from a state in which the discharge current does not flow), and the applied voltage exhibited when the discharge current becomes the predetermined current value (for example, 3 μA) is set as a voltage VLh (hereinafter referred to as "discharge start voltage on a positive potential side"). In the same manner, the transfer voltage having a negative potential (negative polarity) starts being applied to the photosensitive drum 201 from the current value of 0 μA in FIG. 4B (from the state in which the discharge current does not flow), and the applied voltage exhibited when the discharge current becomes the predetermined current value (for example, −3 μA) is set as a voltage VL1 (hereinafter referred to as "discharge start voltage on a negative potential side"). At this time, a voltage difference between the applied voltage exhibited when the current value is 0 μA and the discharge start voltage VLh on the positive potential side and a voltage difference between the applied voltage exhibited when the current value is 0 μA and the discharge start voltage VL1 on the negative potential side are equal to each other, and have a symmetric relationship between a positive potential side and a negative potential side.

When a gap between the transfer roller 204 and the photosensitive drum 201 is assumed to be a gap between a plane and a plane, the above-mentioned characteristic generally known as a discharge phenomenon is the same as a discharge characteristic at the gap between a plane and a plane. In this case, the surface potential of the photosensitive drum 201 can be obtained as follows. When the discharge start voltage VLh on the positive potential side and the discharge start voltage VL1 on the negative potential side described later are used, the surface potential of the photosensitive drum 201 can be calculated by Expression (1) in the following. That is, as shown in FIG. 4B, the surface potential of the photosensitive drum 201 can be obtained as ½ of the sum of the voltage VLh and the voltage VL1.

$$(\text{Surface potential of photosensitive drum 201}) = (VLh + VL1)/2 \quad (1)$$

However, irregularities may be caused on the surface of the transfer roller 204 due to an air bubble formed in terms of a manufacturing method for the transfer roller 204, a paper powder generated on the sheet at a time of image formation, a toner caused to adhere to the transfer roller 204, or the like. In this case, a polarity effect, which is a discharge phenomenon at a gap between a needle and a plane, occurs unlike the above-mentioned discharge characteristic at the gap between a plane and a plane. The polarity effect causes an error between the actual surface potential of the photosensitive drum 201 and the surface potential of the photosensitive drum 201 calculated by Expression (1). This necessitates a correction of the surface potential of the photosensitive drum 201 calculated by Expression (1). A correction amount used in this case is set as a correction amount 1.

[Method of Deriving Correction Amount 1]

Next, in regard to a method of deriving the correction amount 1, a related-art deriving method and a deriving method according to this embodiment are described. First, in the related-art method, only an AC voltage is applied to the photosensitive drum 201 from the charge roller 202, to thereby charge the surface potential of the photosensitive drum 201 to 0 volts (V). After that, the transfer voltage is applied from the transfer roller 204 to the photosensitive drum 201 to measure the discharge start voltage. At this time, a calculation result obtained by Expression (1) is the correction amount 1 for an error with respect to the surface potential of the photosensitive drum 201. That is, when the surface potential of the photosensitive drum 201 is calculated by Expression (1) with the photosensitive drum 201 being charged to the surface potential of 0 volts (V), the calculated surface potential becomes 0 V in the case of the discharge characteristic at the gap between a plane and a plane. However, the calculated surface potential does not become 0 V due to the above-mentioned polarity effect, and the calculation result containing an error is obtained. As a result, the calculated error amount is the correction amount 1 as it is because the actual surface potential of the photosensitive drum 201 is known to be 0 volts (V). The AC voltage needs to be applied by the related-art method because the surface potential of the photosensitive drum 201 is to be set to a known voltage value such as 0 volts (V) when the correction amount 1 is derived. Further, the above-mentioned application is necessary because it is difficult to correctly set the surface potential of the photosensitive drum 201 to 0 V due to the dispersion of the discharge start voltage when the photosensitive drum 201 is charged (subjected to voltage application) with only a DC voltage from the charge roller 202.

Next, in the method according to this embodiment, the DC voltage is first applied to the photosensitive drum 201 from the charge roller 202 to charge the photosensitive drum 201 to a predetermined potential (for example, −400 V). After that, the surface of the photosensitive drum 201 is exposed with the laser light having a higher light amount value than a light amount value used at a normal printing time, to thereby bring the surface potential of the photosensitive drum 201 to a state of 0 V (state in which electricity is removed), and the transfer voltage is applied thereto from the transfer roller 204 to measure the discharge start voltage. Note that, the light amount value used at the normal printing time represents a fixed light amount value used when the laser light is turned on and off based on image information. At this time, the surface potential of the photosensitive drum 201 obtained by Expression (1) is the correction amount 1 for the error. The above-mentioned light amount value of the laser light (hereinafter referred to as "light amount value A") is a light amount value that causes the surface potential of the photosensitive drum 201 to become a saturation potential described later (for example, 1.5 times higher than the light amount used for a normal printing sequence), and is held in a storage unit (not shown) of the control unit 208 in advance. Note that, the light amount value A is set to the light amount value within a saturation area described later which causes no problem in the use of the photosensitive drum 201 even when a surface potential (VL) characteristic of the photosensitive drum 201 with respect to the light amount changes due to a change in the film thickness of the photosensitive drum 201 or the dispersion of the laser light source 207.

[Method of Deriving Correction Amount 2]

Figure 5:
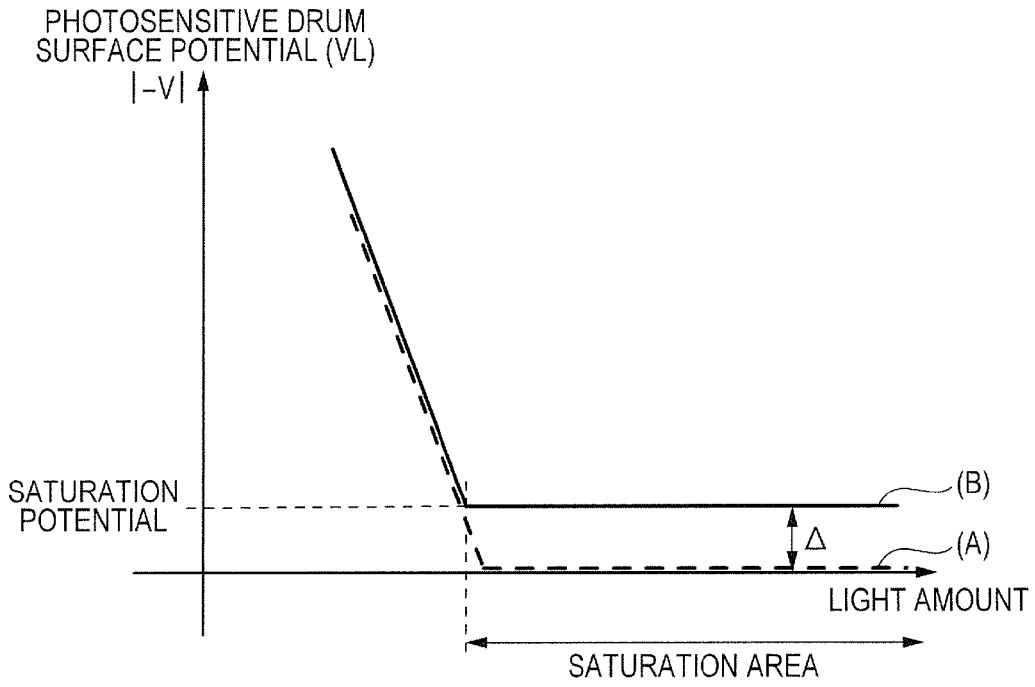
FIG. 5 is a graph for showing a characteristic between a laser light amount and a photosensitive drum potential according to the first embodiment.

FIG. 5 is a characteristic graph for showing a relationship between a laser light amount emitted from the laser light source 207 to the photosensitive drum 201 and the surface potential of the photosensitive drum 201 (VL). In FIG. 5, the horizontal axis indicates the laser light amount, and the vertical axis indicates the surface potential of the photosensitive drum 201 (VL). Note that, the surface potential of the photosensitive drum 201 has a positive potential and a negative potential, and hence the vertical axis in FIG. 5 indicates an absolute value of the potential. As described above, in this embodiment, the photosensitive drum 201 is exposed at the light amount value A, to thereby bring the surface potential of the photosensitive drum 201 to the state of 0 V. The graph for showing a characteristic between the laser light amount and the surface potential of the photosensitive drum 201 exhibited at this time is a graph (A) expressed by the broken line. However, as indicated by a graph (B) expressed by the solid line in FIG. 5, there is a case where the surface potential of the photosensitive drum 201 is not correctly brought to the state of 0 V in terms of the characteristic even when the photosensitive drum 201 is exposed at the light amount value A. That is, as indicated by the graph (B), there exists a saturation area that causes saturation of a potential state of the photosensitive drum 201, and hence the surface potential of the photosensitive drum 201 may fail to be brought to the state of 0 V. The potential exhibited when the photosensitive drum 201 is thus saturated is referred to as "saturation potential". The saturation potential (for example, −10 volts (V)) can be estimated, and hence an estimated value of the saturation potential is stored in the storage unit (not shown) of the control unit 208 in advance.

Therefore, the exposure is conducted at the light amount value A set to a light amount value belonging to the saturation area, which causes the surface potential of the photosensitive drum 201 to be saturated, to bring the surface potential of the photosensitive drum 201 to the state of 0 V, and the transfer voltage is applied thereto from the transfer roller 204 to measure the discharge start voltage. At this time, the correction amount 1 for the error with respect to the surface potential of the photosensitive drum 201 is calculated by the above-mentioned Expression (1). The calculated correction amount 1 contains an amount corresponding to the above-mentioned saturation potential, and hence a correction amount can be obtained with higher accuracy by subtracting the amount corresponding to the saturation potential, that is, the amount (represented by Δ in FIG. 5) corresponding to the potential that causes the photosensitive drum 201 to be saturated, from the calculated correction amount 1. Note that, the amount Δ corresponding to the potential indicating the saturation potential in FIG. 5 is referred to as "correction amount 2". As described above, the correction amount for the surface potential of the photosensitive drum 201 may be only the correction amount 1, but a correction can be made with higher accuracy by using the correction amount with the correction amount 2 taken into consideration, that is, by using (correction amount)=(correction amount 1)−(correction amount 2).

[Calculation of Actual Surface Potential of Photosensitive Drum]

In order to calculate the actual surface potential of the photosensitive drum 201 exhibited after laser irradiation, after the correction amount is calculated, the photosensitive drum 201 is charged to a predetermined voltage other than 0 volts (V) and exposed at a predetermined light amount value. The value of the predetermined voltage and the predetermined light amount value used at this time are values held in the storage unit of the control unit 208 in advance, for example, values set so that the surface potential of the photosensitive drum 201 is estimated to become −150 V under a given state. The actual surface potential of the photosensitive drum 201 exhibited after the laser irradiation can be calculated by subtracting the above-mentioned correction amount from the result calculated by Expression (1) (that is, from the uncorrected surface potential of the photosensitive drum 201). Further, the polarity effect given as the cause of the error that occurs in the control unit 208 configured to calculate the surface potential is merely an example of the error. For example, an error that occurs due to the accuracy of a circuit or an electric characteristic can also be corrected by the correction method according to this embodiment. Expression (1) and the correction amount are both subject to the influence of the error in the accuracy of the circuit or in the electric characteristic. The error amount in Expression (1) and the error amount in the correction amount are substantially equivalent to each other, and hence the influence of the error can be canceled by subtracting the above-mentioned correction amount from the result calculated by Expression (1) (from the uncorrected surface potential of the photosensitive drum 201). In this case, the accuracy of the circuit represents, for example, accuracy determined by a resistance constant, the dispersion in the power supply voltage, or the like, such as the accuracy of the charging voltage application circuit 205. Further, the electric characteristic represents, for example, a semiconductor characteristic of the photosensitive drum 201 exhibited when a voltage is applied to the photosensitive drum 201 from the transfer roller 204.

[Control Sequence for Calculating Actual Surface Potential of Photosensitive Drum]

Figure 6:
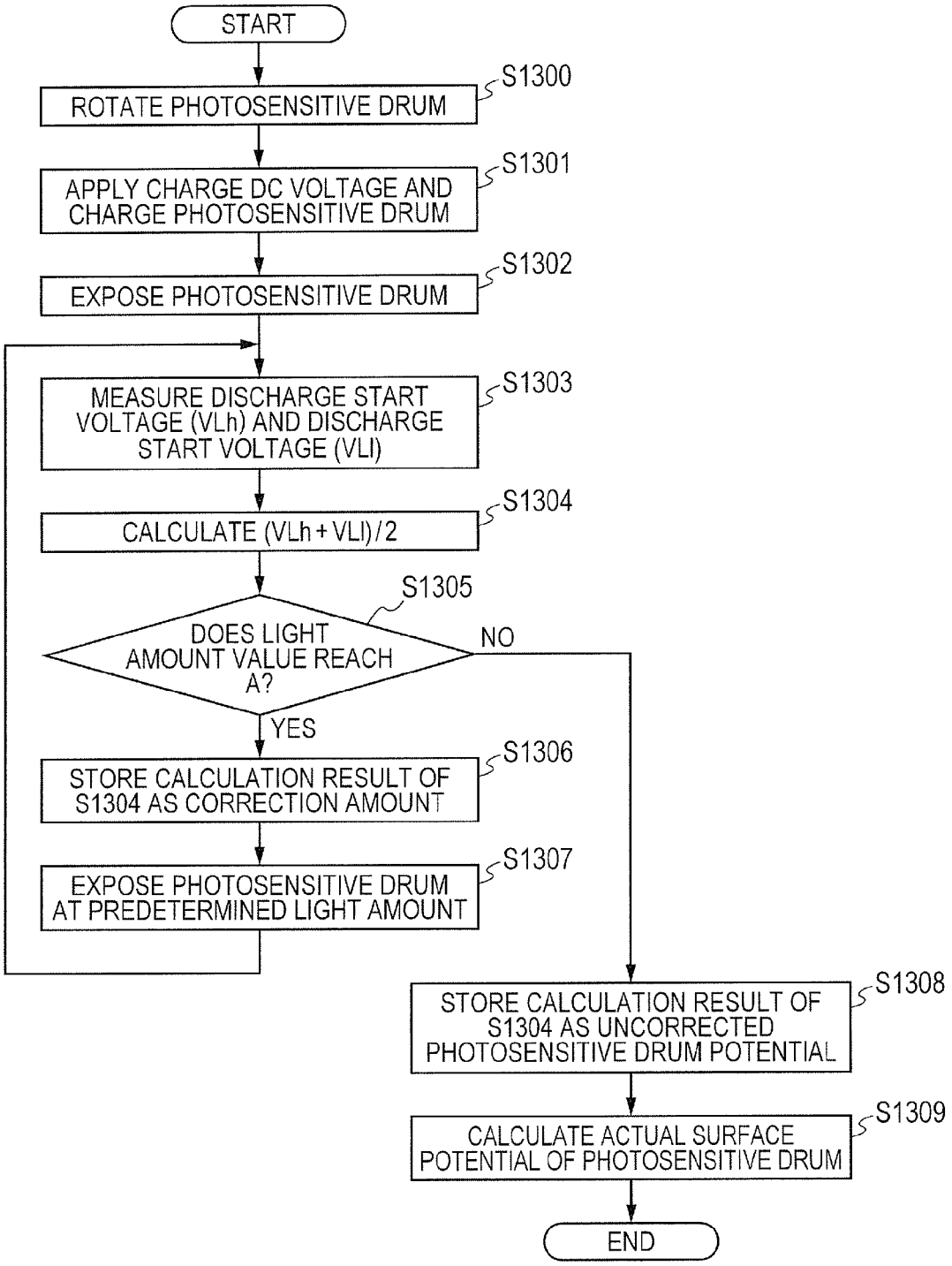
FIG. 6 is a flowchart for illustrating a control sequence for calculating the photosensitive drum potential according to the first embodiment.

A control operation described above is executed by the control unit 208 in accordance with a control sequence illustrated in FIG. 6. FIG. 6 is a flowchart for illustrating a control sequence for calculating the actual surface potential of the photosensitive drum 201. The control sequence is started when a power supply of the printer 100 is turned on or when the control unit 208 receives a print command from an external computer.

In Step S1300, the control unit 208 drives a motor (not shown) to rotate the photosensitive drum 201 for the calibration before printing or the like. In Step S1301, the control unit 208 applies a DC voltage to the photosensitive drum 201 from the charging voltage application circuit 205 through the charge roller 202, and charges the photosensitive drum 201 to a predetermined potential (for example, −400

V). In Step S1302, the control unit 208 reads from the storage unit (not shown) the light amount value A of the light to be emitted from the laser light source 207 to the photosensitive drum 201. Then, the control unit 208 causes the control circuit unit 401 to emit the laser light from the laser diode 405 of the laser light source 207 at the light amount value A to expose the surface of the photosensitive drum 201 and bring the surface potential of the photosensitive drum 201 to the state of 0 V.

In Step S1303, the control unit 208 applies a voltage on the positive potential side of the surface potential of the photosensitive drum 201 to the transfer roller 204 from the transfer voltage application circuit 206, and causes the current detection circuit 301 to measure a discharge current flowing to the photosensitive drum 201. The control unit 208 sets the voltage, which is being applied to the transfer roller 204 when the discharge current notified of by the current detection circuit 301 becomes a predetermined current value (for example, 3 μA), as the discharge start voltage VLh on the positive potential side. In the same manner, the control unit 208 applies a voltage on the negative potential side of the surface potential of the photosensitive drum 201 to the transfer roller 204 from the transfer voltage application circuit 206, and causes the current detection circuit 301 to measure the discharge current. The control unit 208 sets the voltage, which is being applied to the transfer roller 204 when the discharge current notified of by the current detection circuit 301 becomes a predetermined current value (for example, −3 μA), as the discharge start voltage VL1 on the negative potential side.

In Step S1304, the control unit 208 calculates the surface potential of the photosensitive drum 201 by substituting the discharge start voltages VLh and VL1 measured in Step S1303 into Expression (1). In Step S1305, the control unit 208 determines whether or not the surface potential of the photosensitive drum 201 calculated in Step S1304 is the surface potential exhibited at the light amount value A. When determining that the surface potential of the photosensitive drum 201 is the surface potential exhibited at the light amount value A, the control unit 208 advances to Step S1306. When determining that the surface potential of the photosensitive drum 201 is not the surface potential exhibited at the light amount value A, the control unit 208 advances to the processing of Step S1308. In Step S1306, the control unit 208 stores the surface potential of the photosensitive drum 201 exhibited at the light amount value A which is calculated in Step S1304, that is, the correction amount 1 described above, into the storage unit (not shown) as the correction amount used when the actual surface potential of the photosensitive drum 201 is calculated. Further, in order to make a correction with higher accuracy, the control unit 208 may conduct the following processing in Step S1306. That is, the control unit 208 may store into the storage unit (not shown) the correction amount calculated by subtracting the estimated value of the saturation potential which is read from the storage unit (not shown) (correction amount 2 described above) from the surface potential of the photosensitive drum 201 exhibited at the light amount value A which is calculated in Step S1304 (correction amount 1 described above). In Step S1307, the control unit 208 sets a predetermined light amount value as the light amount value of the light to be emitted from the laser light source 207 to the photosensitive drum 201. Then, the control unit 208 causes the control circuit unit 401 to emit the laser light from the laser diode 405 of the laser light source 207 at the predetermined light amount value to expose the surface of the photosensitive drum 201, and returns to the processing of Step S1303.

In Step S1308, the control unit 208 stores the surface potential of the photosensitive drum 201 at the predetermined light amount value calculated in Step S1304 (set in Step S1307), that is, an uncorrected photosensitive drum potential, into the storage unit (not shown). In Step S1309, the control unit 208 reads the correction amount stored in Step S1306 from the storage unit (not shown), calculates the actual surface potential of the photosensitive drum 201 exhibited after the laser irradiation by subtracting the correction amount from the uncorrected photosensitive drum potential stored in Step S1308, and brings the processing to an end. Note that, the control unit 208 starts printing after the end of the processing.

The method of detecting the photosensitive drum potential exhibited after the laser irradiation by conducting the laser irradiation from the laser light source 207 to bring the surface potential of the photosensitive drum 201 to the state of 0 V without applying the AC voltage to the charge roller 202 is described above. In this embodiment, the AC voltage does not need to be applied to the charge roller 202 when the correction amount for the uncorrected photosensitive drum potential is calculated, and hence a circuit configured to generate the AC voltage is not required, which allows reduction in the cost. Further, as described above, the error that occurs due to the accuracy of the circuit or the electric characteristic exhibited when the voltage is applied to the photosensitive drum 201 from the transfer roller 204 can also be corrected through use of the correction method according to this embodiment. Note that, this embodiment is described by using the printer 100 having a configuration formed of one photosensitive drum, but this embodiment is not limited to the image forming apparatus having such a configuration. For example, this embodiment can also be applied to a color printer configured to transfer toner images of respective colors formed on a plurality of photosensitive drums onto an intermediate transfer belt in a superimposed manner, and further transfer a full-color image formed on the intermediate transfer belt onto a recording material.

As described above, according to this embodiment, the photosensitive drum potential can be detected with an inexpensive circuit configuration.

<Second Embodiment>

In the first embodiment, the light amount value A of the laser light used to expose the photosensitive drum when the correction amount is calculated is a predetermined light amount value that causes the surface potential of the photosensitive drum to become the saturation potential. For example, when the film thickness of the photosensitive drum is different, the surface potential of the photosensitive drum differs even when the photosensitive drum is exposed at the same light amount value. Therefore, in a second embodiment of the present invention, a method of setting the light amount value A not as the predetermined light amount value determined in advance but as a proper value corresponding to an environment of the printer 100 based on a result of measuring a characteristic between a light amount value of the printer 100 and the surface potential of the photosensitive drum is described. Note that, a configuration of the printer 100 according to this embodiment is the same as that of the first embodiment, and the same components are denoted by the same reference symbols as those of the first embodiment, descriptions of which are omitted.

[Derivation of Proper Light Amount Value]

Figure 7A:
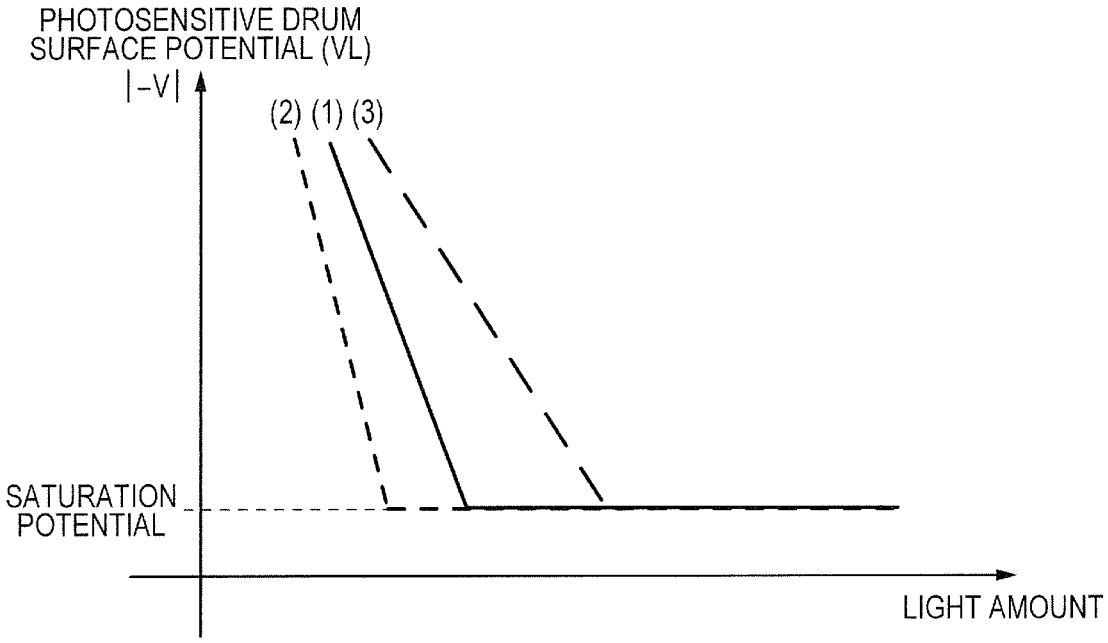
FIG. 7A and FIG. 7B are graphs for showing a characteristic between a laser light amount and a photosensitive drum potential according to the second embodiment.

A relationship (characteristic) between the emitted light amount and the surface potential regarding the photosensitive drum 201 may be influenced by the change in the film thickness of the photosensitive drum 201 or the dispersion of the laser light source 207. FIG. 7A is a characteristic graph for showing a relationship between the laser light amount emitted to the photosensitive drum 201 and the surface potential of the photosensitive drum 201 (VL). In FIG. 7A, the horizontal axis indicates the laser light amount, and the vertical axis indicates the surface potential of the photosensitive drum 201 (VL). Note that, the surface potential of the photosensitive drum 201 has a positive potential and a negative potential, and hence the vertical axis in FIG. 7A indicates an absolute value of the potential. A graph (1) expressed by the solid line in FIG. 7A is a graph for showing a characteristic between the laser light amount and the surface potential of the photosensitive drum 201 under a standard environment. Meanwhile, a graph (2) expressed by the broken line is a graph for showing a characteristic exhibited when the film thickness of the photosensitive drum 201 changes compared with the graph (1), and a graph (3) expressed by the long broken line is a graph for showing a characteristic exhibited when the emitted light amount varies due to the dispersion of the laser light source 207 compared with the graph (1).

Even in a case where the laser light source 207 is set to emit light at the light amount value A by the control unit 208 with the photosensitive drum 201 being charged to the predetermined potential, when the film thickness of the photosensitive drum 201 changes, for example, the characteristic indicated by the graph (2) is exhibited. That is, the difference in the film thickness of the photosensitive drum 201 causes a potential characteristic (surface potential) of the photosensitive drum 201 to differ even when the light is emitted at the same light amount value A. Further, in a case where the laser light source 207 is set to emit light at the light amount value A by the control unit 208 with the photosensitive drum 201 being charged to the predetermined potential, when dispersion occurs in the laser light source 207, for example, the characteristic indicated by the graph (3) is exhibited. That is, dispersion occurs in the actual light amount value of the light emitted from the laser light source 207 to the photosensitive drum 201 even when the laser light source 207 is set so that the light amount value is estimated to become the light amount value A by the control unit 208, and hence the potential characteristic (surface potential) of the photosensitive drum 201 differs.

In this manner, when the film thickness of the photosensitive drum 201 changes or when dispersion occurs in the laser light source 207, the light amount value A may not always be an optimal light amount value depending on the printer 100. In consideration of dispersion of those kinds, for example, a light amount value higher than the current light amount value A can be set as a new light amount value A. In that case, the deterioration in a sensitivity characteristic of the photosensitive drum 201 is promoted, and hence it is not preferred to conduct exposure for a long period of time from the viewpoint of device life. Therefore, in order to set the light amount value A to a proper light amount value, the potential characteristic between the light amount and the photosensitive drum 201 needs to be measured for each printer 100, and the light amount value A corresponding to each printer 100 needs to be derived.

Figure 7B:
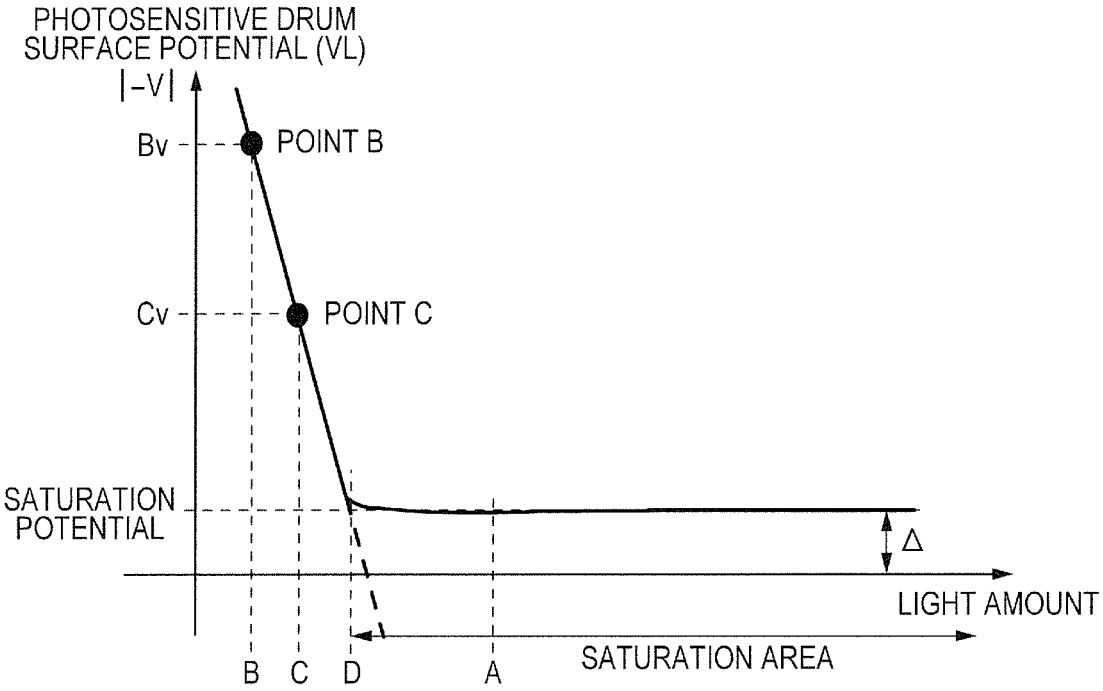

FIG. 7B is an explanatory graph for showing a method of deriving the light amount value A according to this embodiment, and a graph expressed by the solid line is a graph for showing a characteristic exhibited when the photosensitive drum 201 is charged to the predetermined potential. Note that, in the same manner as in FIG. 7A, in FIG. 7B, the horizontal axis indicates the laser light amount, and the vertical axis indicates the surface potential of the photosensitive drum 201 (VL). Further, the symbol Δ in FIG. 7B represents the saturation potential (correction amount 2).

Next, a method of deriving a light amount value is described specifically. First, with the photosensitive drum 201 being charged to the predetermined potential, a potential (Bv) of the photosensitive drum 201 (potential corresponding to a point B in FIG. 7B) exhibited when the photosensitive drum 201 is exposed at a light amount value B is measured. In this case, the light amount value B is a light amount value lower than the light amount corresponding to the saturation potential (D in FIG. 7B) which is exhibited when the photosensitive drum 201 is exposed. In the same manner, a potential (Cv) of the photosensitive drum 201 (potential corresponding to a point C in FIG. 7B) exhibited when the photosensitive drum 201 is exposed at a light amount value C is measured. In this case, the light amount value C is a light amount value lower than the light amount corresponding to the saturation potential (D in FIG. 7B) which is exhibited when the photosensitive drum 201 is exposed, and is a light amount value higher than the light amount value B.

Subsequently, a relational expression that expresses a correspondence relationship between the potential of the photosensitive drum 201 and the light amount value is derived based on the potentials By and Cv of the photosensitive drum 201 measured at the point B and the point C and the light amount values B and C. In this case, the derived relational expression is assumed to be a linear function expressed by $y=\alpha\times x+\beta$. The coefficient α is derived by (coefficient α)=((light amount value B)−(light amount value C))/((potential Bv)−(potential Cv)), and the constant β is derived by (constant β)−(light amount value B)−α×(potential Bv). Note that, y represents the light amount value, and x represents the surface potential of the photosensitive drum 201. A light amount value D corresponding to the saturation potential is obtained by substituting the saturation potential into the relational expression obtained in this manner. A light amount value obtained by multiplying the obtained light amount value D by a predetermined multiplying factor (for example, 1.5 times) is newly determined as a proper light amount value A (=1.5×D) for the printer 100, and is stored into the storage unit of the control unit 208. Note that, the light amount value A newly determined above is set to a light amount value within the saturation area which causes no problem in the use of the photosensitive drum 201 as the light amount value of the light to be emitted to the photosensitive drum 201. Further, in this case, two light amount values B and C are used to derive the relational expression, but the number of light amount values is not limited to two. The relational expression that allows the surface potential of the photosensitive drum 201 to be calculated with higher accuracy can be derived by using a plurality of light amount values, for example, at least three light amount values, to derive the relational expression.

[Control Sequence for Calculating Actual Surface Potential of Photosensitive Drum and Proper Light Amount Value]

Figure 8:
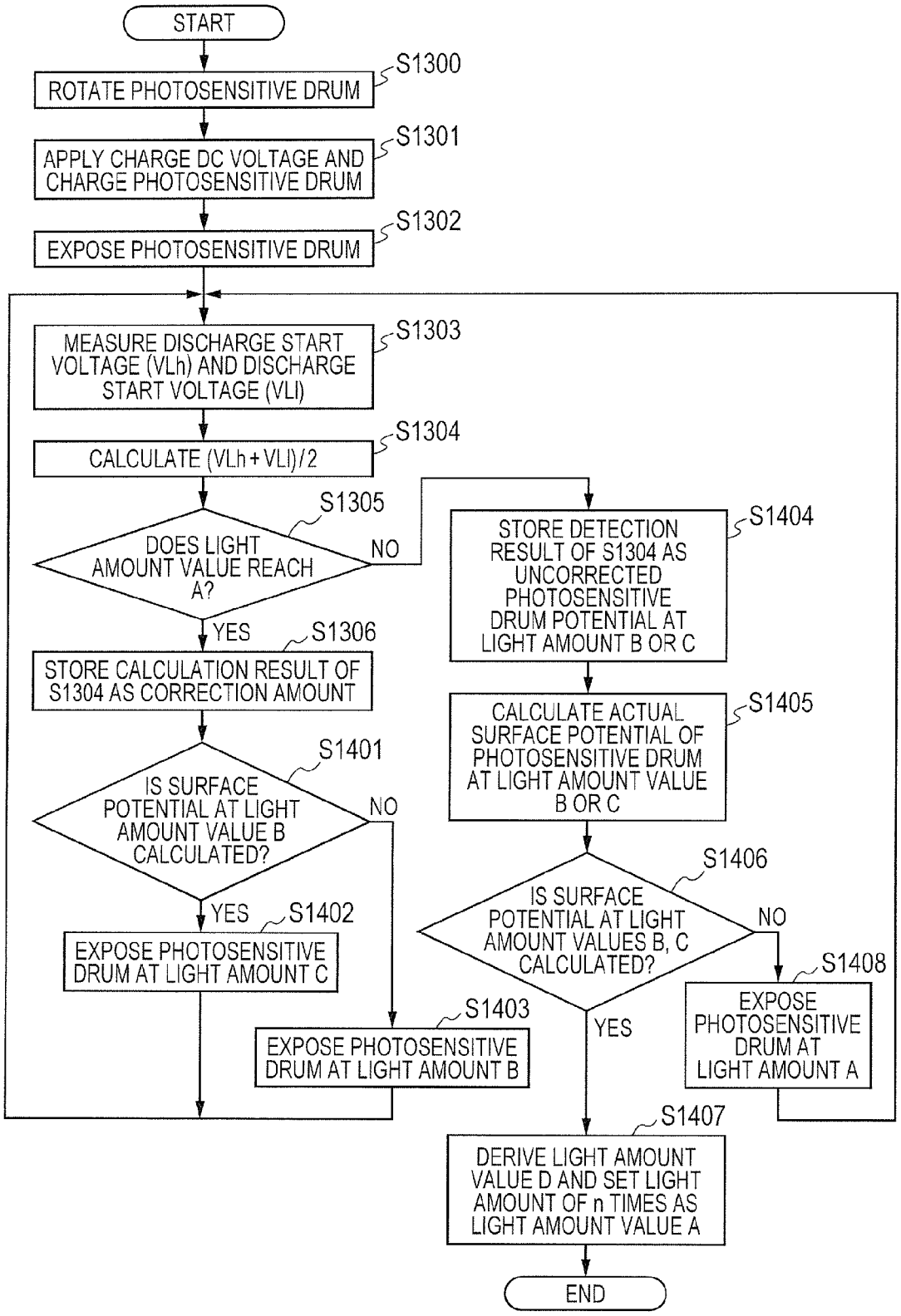
FIG. 8 is a flowchart for illustrating a control sequence for calculating the photosensitive drum potential according to the second embodiment.

FIG. 8 is a flowchart for illustrating a control sequence for calculating the actual surface potential of the photosensitive drum 201 and the proper light amount value. The control sequence is started when the power supply of the printer 100 is turned on or when the control unit 208 receives a print command from an external computer. Note that, the same processing steps as those of FIG. 6 in the first embodiment are denoted by the same step numbers as those of FIG. 6, and detailed descriptions thereof are omitted. Note that, it is assumed that the values of the light amount value B and the light amount value C, which are used when the surface potential of the photosensitive drum 201 is measured at the point B and the point C in FIG. 7B in order to derive the above-mentioned light amount value D, are stored in the storage unit (not shown) of the control unit 208 in advance.

In FIG. 8, the processing of Step S1300 to Step S1302 is the processing for applying the DC voltage from the charge roller 202 to charge the photosensitive drum 201 to the predetermined potential and exposing the photosensitive drum 201 at the light amount value A, but is the same processing as that of FIG. 6 in the first embodiment, and a description thereof is omitted below. Further, the processing of Step S1303 and Step S1304 is the same processing as that of FIG. 6, and a description thereof is omitted.

In Step S1305, the control unit 208 determines whether or not the surface potential of the photosensitive drum 201 calculated in Step S1304 is the surface potential exhibited at the light amount value A. When determining that the surface potential of the photosensitive drum 201 is the surface potential exhibited at the light amount value A, the control unit 208 advances to Step S1306. When determining that the surface potential of the photosensitive drum 201 is not the surface potential exhibited at the light amount value A, the control unit 208 advances to the processing of Step S1404. In Step S1306, the control unit 208 stores the surface potential of the photosensitive drum 201 exhibited at the light amount value A which is calculated in Step S1304, that is, the correction amount 1 described above, into the storage unit (not shown) as the correction amount used when the actual surface potential of the photosensitive drum 201 is calculated. Further, in order to make a correction with higher accuracy, the control unit 208 may conduct the following processing in Step S1306. That is, the control unit 208 may store the correction amount calculated by subtracting the saturation potential (correction amount 2 described above) which is read from the storage unit (not shown) from the surface potential of the photosensitive drum 201 exhibited at the light amount value A which is calculated in Step S1304 (correction amount 1 described above) into the storage unit (not shown).

In Step S1401, the control unit 208 determines whether or not the surface potential of the photosensitive drum 201 at the light amount value B has been calculated. When determining that the surface potential at the light amount value B has already been calculated, the control unit 208 advances to the processing of Step S1402. When determining that the surface potential at the light amount value B has not been calculated yet, the control unit 208 advances to the processing of Step S1403. In Step S1402, the control unit 208 reads from the storage unit (not shown) the light amount value C of the light to be emitted from the laser light source 207 to the photosensitive drum 201. Then, the control unit 208 causes the control circuit unit 401 to emit the laser light from the laser diode 405 of the laser light source 207 at the light amount value C to expose the surface of the photosensitive drum 201, and returns to the processing of Step S1303. In Step S1403, the control unit 208 reads from the storage unit (not shown) the light amount value B of the light to be emitted from the laser light source 207 to the photosensitive drum 201. Then, the control unit 208 causes the control circuit unit 401 to emit the laser light from the laser diode 405 of the laser light source 207 at the light amount value B to expose the surface of the photosensitive drum 201, and returns to the processing of Step S1303.

In Step S1404, the control unit 208 stores the surface potential of the photosensitive drum 201 calculated in Step S1304, namely, the uncorrected photosensitive drum potential, into the storage unit (not shown) as the light amount value B or C in association with a laser light amount value of the light emitted to the photosensitive drum 201. In Step S1405, the control unit 208 reads the correction amount stored in Step S1306 from the storage unit (not shown), and subtracts the correction amount from the uncorrected photosensitive drum potential at the light amount value B or C stored in the storage unit (not shown) in Step S1404. The control unit 208 thus calculates the actual surface potential of the photosensitive drum 201 exhibited after the laser irradiation at the light amount value B or C. The control unit 208 stores the calculated actual surface potential of the photosensitive drum 201 exhibited after the laser irradiation into the storage unit (not shown) as the surface potential By at the light amount value B or the surface potential Cv at the light amount value C in association with the light amount value.

In Step S1406, the control unit 208 determines whether or not the actual surface potentials of the photosensitive drum 201 exhibited after the laser irradiation at the light amount value B and the light amount value C have been calculated. When determining that the surface potentials at the light amount value B and the light amount value C have been calculated, the control unit 208 advances to the processing of Step S1407. When determining that only the surface potential at any one of the light amount value B and the light amount value C has been calculated, the control unit 208 advances to the processing of Step S1408. In Step S1407, the control unit 208 derives the above-mentioned relational expression based on the light amount values B and C stored in the storage unit (not shown) and the surface potentials By and Cv of the photosensitive drum 201 corresponding to the light amount values B and C. Then, the control unit 208 derives the light amount value D corresponding to the saturation potential by substituting the saturation potential (for example, −10 V) read from the storage unit (not shown) into the derived relational expression. Then, the control unit 208 sets the light amount value obtained by multiplying the derived light amount value D by a predetermined multiplying factor (for example, 1.5 times) (multiplying the derived light amount value D by n) as the new proper light amount value A for the printer 100, replaces the light amount value A stored in the storage unit (not shown) by the new proper light amount value A, and brings the processing to an end. In Step S1408, the control unit 208 reads from the storage unit (not shown) the light amount value A of the light to be emitted from the laser light source 207 to the photosensitive drum 201. Then, the control unit 208 causes the control circuit unit 401 to emit the laser light from the laser diode 405 of the laser light source 207 at the light amount value A to expose the surface of the photosensitive drum 201, and returns to the processing of Step S1303.

As described above, with the method according to this embodiment, the proper light amount value A can be determined even when the potential characteristic between the light amount and the photosensitive drum 201 changes due to the change in the film thickness of the photosensitive drum 201 or the dispersion of the laser light source 207. Note that, this embodiment is described by assuming that the light amount value D is obtained by deriving the relational expression from the light amount values B and C and the surface potentials By and Cv and substituting the saturation potential into the relational expression, but this embodiment is not limited to this method. For example, the same effect can also be produced when the control unit 208 gradually increases the light amount value from the light amount value lower than the saturation area while monitoring the current value detected by the current detection circuit 301, and sets the light amount value exhibited when there is almost no change in the current value as the light amount value D.

As described above, according to this embodiment, the photosensitive drum potential can be detected with an inexpensive circuit configuration. Note that, in the first embodiment and the second embodiment described above, the laser light is used as means for exposing the photosensitive drum 201, but the present invention is not limited thereto, and a method of exposing the photosensitive drum through use of an LED may be employed. Even when the LED is used as the exposure means, control may be conducted so as to expose the photosensitive drum at a light amount higher than the exposure amount used when the electrostatic latent image corresponding to the image data is formed on the photosensitive drum.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-059774, filed Mar. 23, 2015, which is hereby incorporated by reference herein in its entirety.

What is claimed is:

1. An image forming apparatus, comprising:

an image bearing member;

a charge unit configured to charge the image bearing member;

an exposure unit configured to expose the image bearing member by emitting light thereto;

a transfer unit configured to transfer an image formed on the image bearing member;

an application unit configured to apply a voltage to the transfer unit;

a detection unit configured to detect a current flowing between the transfer unit and the image bearing member when the voltage is applied to the transfer unit; and a control unit configured to cause the charge unit to charge the image bearing member through application of a DC voltage, and to calculate a surface potential of the image bearing member based on a detection result of the current flowing to the image bearing member detected by the detection unit when the voltage is applied to the transfer unit after the exposure unit emits a light, whose light amount value is higher than a light amount value of a light emitted to the image bearing member in an image formation, to the image bearing member, wherein the control unit (i) calculates a first voltage with positive polarity applied from the application unit to the transfer unit in the case where the control unit controls the application unit to apply a voltage with a positive polarity from the application unit to the transfer unit and the detection unit detects a current with a predetermined current value, (ii) calculates a second voltage with negative polarity applied from the application unit to the transfer unit in the case where the control unit controls the application unit to apply a voltage with a negative polarity from the application unit to the transfer unit and the detection unit detects a current with a predetermined current value, and (iii) determines a surface voltage of the image bearing member by the calculated first and second voltages.

2. An image forming apparatus according to claim 1, wherein the light amount value higher than the light amount value of the light emitted from the exposure unit to the image bearing member in the image formation comprises a light amount value that causes the surface potential of the image bearing member to become a saturation potential.

3. An image forming apparatus according to claim 2, wherein the control unit is further configured to determine a surface potential obtained by subtracting the correction amount from a surface potential of the image bearing member, which is calculated when the image bearing member is exposed by the exposure unit at a predetermined light amount value corresponding to the saturation potential, as the surface potential of the image bearing member.

4. An image forming apparatus according to claim 2, wherein the control unit is further configured to calculate a light amount value that causes the surface potential of the image bearing member to become the saturation potential based on surface potentials of the image bearing member which are calculated when the light is emitted from the exposure unit to the image bearing member at a plurality of light amount values whose surface potential of the image bearing member does not become the saturation potential and which corresponds to each of the plurality of light amount values;

and determine the higher light amount value based on the calculated light amount value.

5. An image forming apparatus according to claim 4, wherein the control unit is configured to derive a relational expression for associating the light amount value with the surface potential based on the plurality of light amount values and the surface potentials of the image bearing member which are calculated when the image bearing member is exposed at the plurality of light amount values and which respectively correspond to the plurality of light amount values; and calculate the light amount value exhibited when the surface potential of the image bearing member becomes the saturation potential based on the derived relational expression.

6. An image forming apparatus according to claim 1, wherein the control unit calculates a half of a summation of the first and second voltages as a correction value and determines a surface potential of the image bearing member by the correction value.

7. An image forming apparatus according to claim 1, wherein the exposure unit comprises a unit which includes a laser light source and which is configured to emit laser light at a light amount corresponding to image data from the laser light source.

8. An image forming apparatus according to claim 1, wherein the exposure unit comprises a unit which includes an LED and which is configured to emit the light at a light amount corresponding to image data from the LED.

9. An image forming apparatus according to claim 1, further comprising a light-receiving unit configured to receive the light emitted from the exposure unit, wherein the control unit is further configured to control the exposure unit based on light reception of the light-receiving unit so as to maintain the light amount value of the light emitted from the exposure unit at a constant level.

10. An image forming apparatus, comprising:

an image bearing member;

a charge unit configured to charge the image bearing member;

an exposure unit configured to expose the image bearing member by emitting light thereto;

a transfer unit configured to transfer an image formed on the image bearing member;

an application unit configured to apply a voltage to the transfer unit;

a detection unit configured to detect a current flowing between the transfer unit and the image bearing member when the voltage is applied to the transfer unit; and a control unit configured to cause the charge unit to charge the image bearing member through application of a DC voltage, and to calculate a surface potential of the image bearing member based on a detection result of the current flowing to the image bearing member detected by the detection unit when the voltage is applied to the transfer unit after the exposure unit emits a light, whose light amount value is higher than a light amount value of a light emitted to the image bearing member in an image formation, to the image bearing member, wherein the control unit (i) calculates a first voltage with positive polarity applied from the application unit to the transfer unit in the case where the control unit controls the application unit to apply a voltage with positive polarity from the application unit to the transfer unit and the detection unit detects a current with a predetermined current value, (ii) calculates a second voltage with negative polarity applied from the application unit to the transfer unit in the case where the control unit controls the application unit to apply a voltage with negative polarity from the application unit to the transfer unit and the detection unit detects a current with a predetermined current value, and (iii) determines a surface voltage of the image bearing member by the calculated first and second voltages, wherein the light amount value higher than the light amount value of the light emitted from the exposure unit to the image bearing member in the image formation comprises a light amount value that causes the surface potential of the image bearing member to become a saturation potential, and wherein the control unit is further configured to set a surface potential obtained by subtracting the saturation potential of the image bearing member from a surface potential of the image bearing member, which is calculated as a half of a summation of the first voltage and the second voltage as a correction value and determines the surface potential of the image bearing member.

* * * * *